US006509882B2

(12) United States Patent
McKivergan

(10) Patent No.: US 6,509,882 B2
(45) Date of Patent: Jan. 21, 2003

(54) LOW SAR BROADBAND ANTENNA ASSEMBLY

(75) Inventor: Patrick D. McKivergan, Scotts Valley, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/737,215

(22) Filed: Dec. 14, 2000

(65) Prior Publication Data

US 2002/0075187 A1 Jun. 20, 2002

Related U.S. Application Data

(60) Provisional application No. 60/170,600, filed on Dec. 14, 1999.

(51) Int. Cl.[7] ..... H01Q 9/28

(52) U.S. Cl. ..... 343/818; 343/700 MS; 343/702; 343/795

(58) Field of Search ..... 343/700 MS, 702, 343/795, 814, 815, 816, 817, 818, 819, 829, 846; H01Q 9/28

(56) References Cited

U.S. PATENT DOCUMENTS

| | | | | | |
|---|---|---|---|---|---|
| 4,072,951 | A | | 2/1978 | Kaloi | 343/700 |
| 4,494,120 | A | * | 1/1985 | Garay | 343/702 |
| 4,584,585 | A | | 4/1986 | Marko et al. | 343/702 |
| 4,591,863 | A | | 5/1986 | Patsiokas | 343/702 |
| 4,628,322 | A | | 12/1986 | Marko et al. | 343/702 |
| 4,700,194 | A | | 10/1987 | Ogawa et al. | 343/700 |
| 4,849,765 | A | | 7/1989 | Marko | 343/702 |
| 4,924,237 | A | | 5/1990 | Honda et al. | 343/702 |
| 5,061,939 | A | | 10/1991 | Nakase | 343/700 |
| 5,148,181 | A | | 9/1992 | Yokoyama et al. | 343/702 |
| 5,173,715 | A | * | 12/1992 | Rodal et al. | 343/795 |
| 5,231,407 | A | | 7/1993 | McGirr et al. | 343/700 |
| 5,291,210 | A | * | 3/1994 | Nakase | 343/700 MS |
| 5,420,596 | A | | 5/1995 | Burrell et al. | 343/700 |
| 5,510,802 | A | | 4/1996 | Tsuru et al. | 343/700 |
| 5,537,123 | A | | 7/1996 | Mandai et al. | 343/700 |
| 5,541,610 | A | | 7/1996 | Imanishi et al. | 343/702 |
| 5,550,554 | A | | 8/1996 | Erkocevic | 343/828 |
| 5,583,521 | A | | 12/1996 | Williams | 343/702 |
| 5,585,807 | A | | 12/1996 | Takei | 343/702 |
| 5,627,550 | A | | 5/1997 | Sanad | 343/700 |
| 5,680,144 | A | | 10/1997 | Sanad | 343/700 |
| 5,909,198 | A | | 6/1999 | Mandei et al. | 343/895 |
| 5,912,647 | A | | 6/1999 | Tsuru et al. | 343/700 |
| 5,929,812 | A | | 7/1999 | Aminzadeh | 343/700 |
| 5,929,813 | A | | 7/1999 | Eggleston | 343/700 |
| 5,933,116 | A | | 8/1999 | Svesada et al. | 343/702 |
| 5,936,583 | A | | 8/1999 | Sekine et al. | 343/702 |

(List continued on next page.)

FOREIGN PATENT DOCUMENTS

| | | | |
|---|---|---|---|
| EP | 087683 A1 | 9/1983 | H01Q/13/10 |
| WO | 09903166 | 1/1999 | H01Q/1/24 |

OTHER PUBLICATIONS

PCT/US00/33943 International Search Report, dated Jun. 27, 2001.

PCT/US00/33943 Written Opinion, dated Oct. 23, 2001.

*Primary Examiner*—Tho Phan

(74) *Attorney, Agent, or Firm*—Fulbright & Jaworski L.L.P.

(57) ABSTRACT

A low specific absorption rate broadband antenna assembly for use with a wireless communication device. The antenna assembly includes a driven element and a parasitic element which are operatively connected to a radio frequency input/output port and a ground plane, respectively, and which are superposed above a predetermined region of a ground plane having a predetermined configuration. The driven and parasitic elements may take the form of traces or wires which are disposed away from each other by a distance related to the frequency of operation. The traces may be formed on one side of a suitable dielectric substrate such as a printed circuit board, while the wires may be self supporting and not requiring a dielectric substrate.

53 Claims, 13 Drawing Sheets

U.S. PATENT DOCUMENTS 5,940,041 A 8/1999 Koyama et al. ..... 343/702
5,952,970 A 9/1999 Kawahata ..... 343/703
5,966,097 A 10/1999 Fukasawa ..... 343/700
6,002,367 A 12/1999 Englom et al. ..... 343/700
6,008,762 A 12/1999 Nghiem ..... 343/700
6,008,764 A 12/1999 Ollikainen et al. ..... 343/700
6,008,773 A 12/1999 Matsuoka et al. ..... 343/818
6,040,803 A * 3/2000 Spall ..... 343/700 MS
6,157,348 A 12/2000 Openlander ..... 343/846

* cited by examiner

TABLE 1 UMTS BAND 1920-2170 MHz

| DIMENSION | VALUE (inches) | VALUE(λ) |
|---|---|---|
| A | 0.522 | 0.0904 |
| B | 0.880 | 0.1524 |
| C | 0.780 | 0.1351 |
| D | 0.700 | 0.1212 |
| E | 0.250 | 0.0433 |
| F | 0.600 | 0.1039 |
| B | 0.336 | 0.0582 |
| H | 0.157 | 0.0272 |
| I | 0.050 | 0.0087 |
| J | 0.402 | 0.0696 |
| K | 0.395 | 0.0684 |
| L | 0.309 | 0.0535 |
| M | 0.255 | 0.0442 |
| N | 1.007 | 0.1744 |
| O | 0.496 | 0.0859 |
| P | 0.388 | 0.0672 |
| Q | 0.250 | 0.0433 |
| R | 0.280 | 0.0485 |

FIG. 7b

TABLE 2 UMTS BAND 1920-2170 MHz

| DIMENSION | VALUE (inches) | VALUE(λ) |
|---|---|---|
| a | 1.475 | .2554 |
| b | 0.776 | .1334 |
| c | 2.380 | .4121 |
| d | 0.629 | .1084 |
| e | 0.264 | .0457 |
| f | 0.527 | .0912 |
| g | 0.165 | .0386 |
| h | 0.927 | .1605 |
| i | 0.624 | .1080 |
| j | 0.435 | .0753 |
| k | 0.500 | .0866 |
| l | 0.280 | .0485 |

FIG. 9c

TABLE 3 UMTS BAND 1710-2500 MHz

| DIMENSION | VALUE (inches) | VALUE(λ) |
|---|---|---|
| AA | 0.879 | .1522 |
| BB | 0.095 | .0164 |
| CC | 0.756 | .1309 |
| DD | 0.565 | .0978 |

LOW SAR BROADBAND ANTENNA ASSEMBLY

This application claims the benefit of U.S. Provisional Application No. 60/170,600 filed Dec. 14, 1999.

FIELD OF THE INVENTION

The present invention relates to an antenna assembly suitable for wireless transmission of analog and/or digital data, and more particularly to a highly compact broadband antenna assembly having a low specific absorption rate for use with wireless communication devices.

BACKGROUND OF THE INVENTION

There are a variety of antennas which are currently used in wireless communication devices. One type of antenna is an external half wave single or multi-band dipole. This antenna typically extends or is extensible from the body of a wireless communication device in a linear fashion during normal operation. Because of the physical configuration of this type of antenna, it is relatively insensitive to directional signal optimization. In other words, it is able to operate in a variety of positions without substantial signal degradation and is considered omni-directional. This means that not only do electromagnetic waves radiate equally toward and away from such an antenna, they also radiate equally toward and away from a user of a wireless communication device equipped with such an antenna. There is essentially no front-to-back ratio (with respect to a wireless communication device) and little or no Specific Absorption Rate (SAR) reduction with this type of antenna. With multi-band versions of this type of antenna, where resonances are achieved through the use of inductor-capacitor (LC) traps, gains of +2 dBi are common.

While this type of antenna is acceptable in some wireless communication devices, it has drawbacks. One significant drawback is that the antenna is external to the body of the communication device. This places the antenna in an exposed position where it may be accidentally or deliberately damaged. Another drawback of increasing importance is due to the inherent omni-directionality of the antenna. That is, that which enables the antenna to operate optimally, may subject a user of a wireless communication device to unacceptable levels of electromagnetic radiation when the device is operated proximate a user.

A related antenna is an external quarter wave single or multi-band asymmetric wire dipole. This antenna operates much like the aforementioned antenna, but requires an additional quarter wave conductor to produce additional resonances and has drawbacks similar to the aforementioned half wave single or multi-band dipole antenna.

Another type of antenna is the internal single or multi band asymmetric dipole. This type of antenna usually features quarter wave resonant conductor traces, which may be located on a planar printed circuit board within the body of a wireless communication device. Such antennas typically operate over one or more frequency ranges with gains of +1–2 dBi. This antenna may include one or more feed points for multiple band operation, and may require a second conductor for additional band resonance.

Yet another antenna is an internal single or multi-band Planar Inverted "F" Antenna (PIFA). This type of antenna features a single or multiple resonant planar conductor that operates over a second conductor or ground plane. With this type of antenna, gains of +1.5 dBi are typical.

Another type of antenna is a patch antenna. The patch antenna is a small, low profile antenna which is useful in wireless communication devices. They typically have operating bandwidths (2:1 Standing Voltage Wave Ratio) on the order of a few percent. The operating bandwidth may be increased by adding parasitic elements. However, the total size of the antenna increases proportionately. The front to back ratio is usually poor unless the ground plane size is also increased. Thus, in creating a patch antenna with a relatively large bandwidth, the primary advantage of the patch antenna is defeated.

Each of these known various antenna structures have limitations, including a decrease in operational efficiency when positioned near a user's head. As a result, there exists a need for a broadband antenna assembly which is compact and lightweight. Yet another need exists for an unitary antenna structure having a wide bandwidth without a separate antenna structure for each transmission and reception band. Still another need exists for an antenna having reduced SAR. There is a need for an antenna assembly which may be incorporated into a variety of wireless communication devices. There is also a need for an antenna assembly with a reduced specific absorption rate.

SUMMARY OF THE INVENTION

A broadband antenna assembly having a low specific absorption rate for use with a wireless communication device. The antenna assembly includes a driven element and parasitic element, operatively connected to a radio frequency input/output port and a ground plane, such as provided by the printed circuit board of the communication device. The driven element may take the form of a first trace on a suitable substrate or take the form of a first body member, while the parasitic element may take the form of a second trace on a suitable substrate or take the form of a second body member. Importantly, the overall length of both the driven and parasitic element is substantially less than $\frac{1}{4}\lambda$.

In the first embodiment, the first and second traces are formed on one side of a suitable substrate such as a printed circuit board which is then superposed above a predetermined region of a ground plane by connector members. Generally, the first trace has two ends, with one end having a feed point to which a first connector member is attached, while the second trace has a plurality of segments with ends, with one of the ends having a ground connection point to which a second connector member is attached. The first and second connector members operatively couple the first trace to an input/output port and the second trace to the ground plane, respectively. Preferably, the input/output port is adjacent to and in a fixed position relative to the ground plane to enable the connector members to align and support the substrate and the traces. For optimum operation, the first and second traces are spaced apart from each other by a distance that establishes proper coupling to the frequency band of operation. As a result, a compact high bandwidth antenna is provided.

In the second embodiment of the antenna assembly, the first and second body members are superposed above a predetermined region of a ground plane by connector members. Generally, the first body member has a plurality of segments with one end operatively connected by a first connector member to an input/output port, while the second body member has a plurality of segments and with one end operatively connected by a second connector member to a ground plane. Preferably, the input/output port is adjacent to and in a fixed position relative to the ground plane to enable the first connector member to align and support the first body member. The opposite ends of both the first and second body members includes an arm member which extends toward the ground plane. More specifically, the first and second body members are co-planar with their respective arm members and having roughly the same extension toward the ground plane. Preferably, the second body member comprises two segments which form a predetermined angle with the apex of the angle proximate the first body member. As with the aforementioned first embodiment or form, the first and second body members are spaced from each other by a distance related to the frequency of operation.

In a third embodiment, the first and second body members of the aforementioned second embodiment may be used as a feed system for an auxiliary antenna element, with the auxiliary antenna element comprising a dielectric member and a conductor element. Preferably, the auxiliary antenna element is superposed above and adjacent to the first and second body members of the aforementioned second embodiment. In use, the auxiliary antenna element extends the bandwidth of the first and second body members. In another embodiment, the antenna may be manufactured as a plated or foil conductive material imprinted or disposed upon a dielectric substrate using known printed circuit fabrication techniques. In the third embodiment, the aforementioned body members of the second embodiment of the antenna assembly are used in conjunction with an auxiliary antenna element. Said auxiliary antenna element may be composed of a metallic plate supported by a dielectric substrate which provides the proper spacing to the antenna feed system and the ground plane element which may be the ground plane of the printed wiring board of a communication device.

In a fourth embodiment, a multiple band antenna assembly is provided. In an illustrated embodiment, the antenna assembly includes a plurality of stacked antenna elements, each defined with respect to a different frequency band of operation. Additionally, the stacked antenna elements may be disposed in substantially parallel relationship with each other.

As with all of the embodiments, it will be appreciated that various componentry may be positioned within the open space(s) between the antenna assembly and the ground plane to facilitate compact construction.

It is an object of the present invention to provide an antenna assembly which may be incorporated into a wireless communication device.

Another object of the present invention to enhance operation of an antenna assembly by increasing its operational bandwidth.

A feature of the present invention is that there is a single feed point for multiple electromagnetic frequency ranges or bands.

Another feature of the present invention is that fabrication may be accomplished through existing technologies and mass production techniques.

Yet another feature of the present invention is the provision of a low specific absorption rate (SAR) antenna.

An advantage of the present invention is that the antenna assembly has a low profile which enables it to be used in small articles such as wireless communication devices.

Another advantage of the present invention is that various components of a transceiver device may be positioned within interior regions of the antenna assembly to reduce the overall size of the electronic device.

Yet another advantage of the present invention is that a multiple band antenna may be implemented having a plurality of individual antenna structures, each structure associated with a given frequency band of operation. In one preferred embodiment, the plurality of individual antenna structures may be stacked in a substantially parallel manner.

These and other objects, features and advantages will become apparent in light of the following detailed description of the preferred embodiments in connection with the drawings.

BRIEF DESCRIPTION OF THE DRAWINGS

FIG. 7B is a table showing preferred dimensions of the antenna assembly of FIG. 7A, according to the present invention;

FIG. 9C is a table showing preferred dimensions of the antenna assembly of FIG. 9A, according to the present invention;

DETAILED DESCRIPTION OF THE PREFERRED EMBODIMENTS

Figure 1:
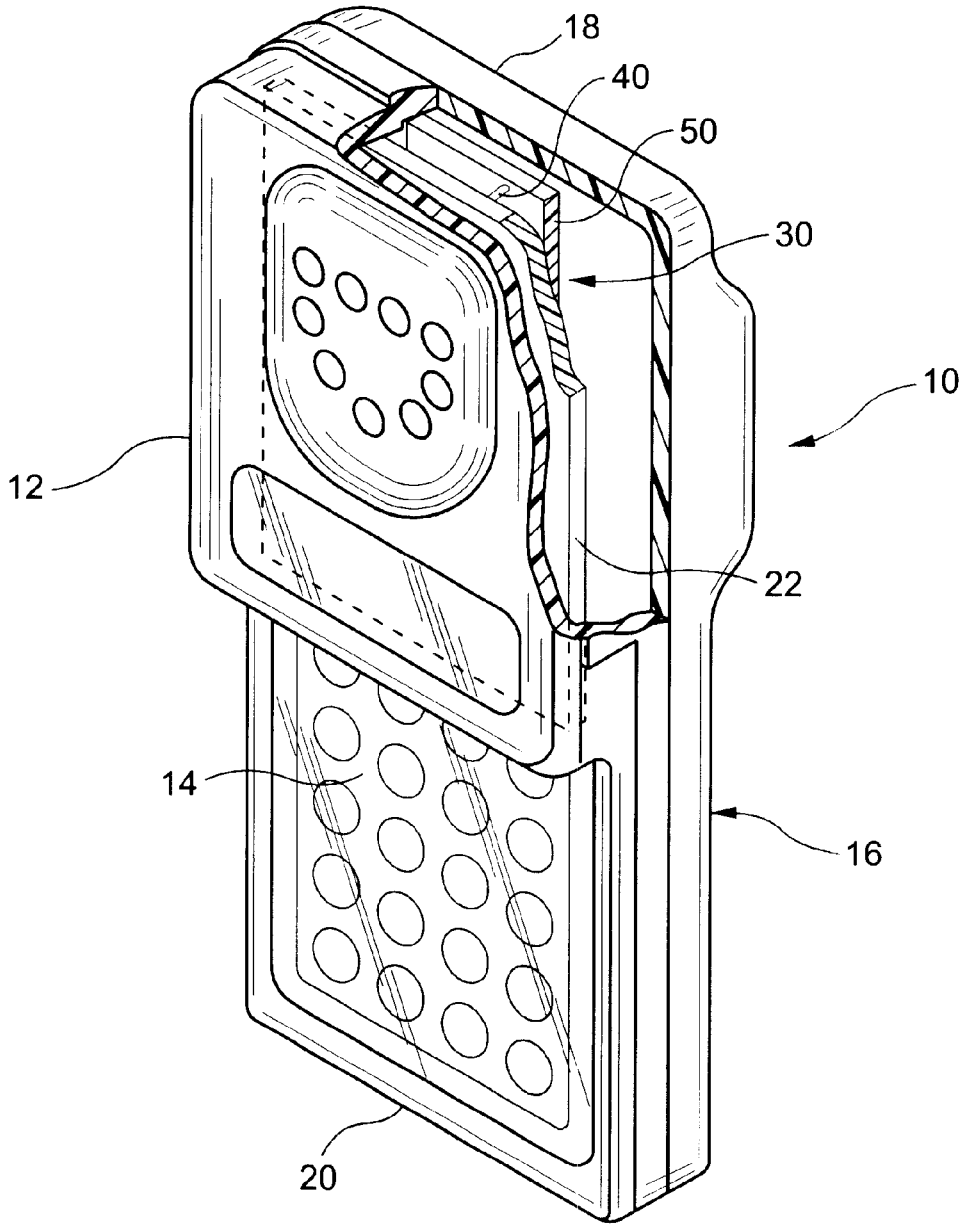
FIG. 1 is a partial, cross-sectional perspective view of a wireless communication device incorporating an antenna assembly according to the present invention.
Figure 2:
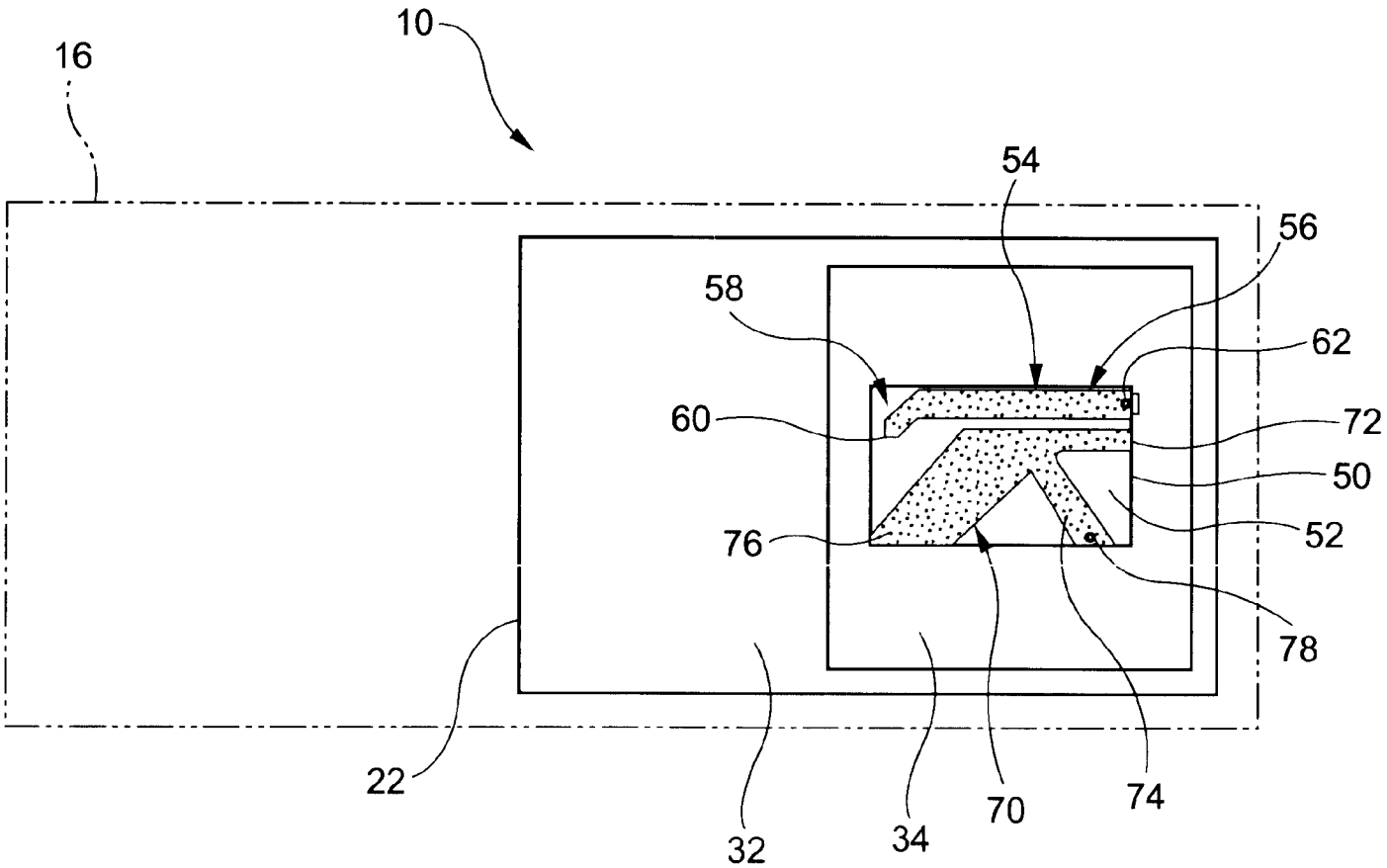
FIG. 2 is a plan view of a first embodiment of the antenna assembly according to the present invention taken from the back of a wireless communication device, the wireless communication device depicted in phantom.

Referring now to the drawings, wherein like numerals depict like parts throughout, FIG. 1 illustrates a wireless communications device (WCD) 10 having a housing 12 with a front 14, a rear or back 16, a top 18 a bottom 20 and a printed wiring board (PWB) 22. A portion of the wireless communications device and the printed wiring board have been broken away to illustrate the juxtaposition of the printed wiring board 22 and the antenna assembly 30. The antenna assembly 30 of the present invention includes a ground plane 32, which may be carried by the printed PWB 22.

A first preferred embodiment of the present invention may be seen in FIGS. 2–4B. Here, the antenna assembly 30 comprises a dielectric element 50 having a major surface 52 in supporting relation to a driven element 54 and a parasitic element 70. The driven element 54, illustrated in this embodiment as a trace 54, includes opposing ends 56, 58 with one end including a tip 60 and the other end including a feed point 62. The parasitic element or trace 70 includes first, second and third segments, 72, 74, 76 with an end of the second segment 74 including a ground connection point 78. The driven and parasitic elements or traces 54, 70 are operatively connected to an RF input/output port 44 and a ground point 46 on the ground plane 32 by first and second connector members 40, 42, respectively. Importantly, the overall length of both the driven and parasitic element 54, 70 is substantially less than ¼λ.

Figure 3B:
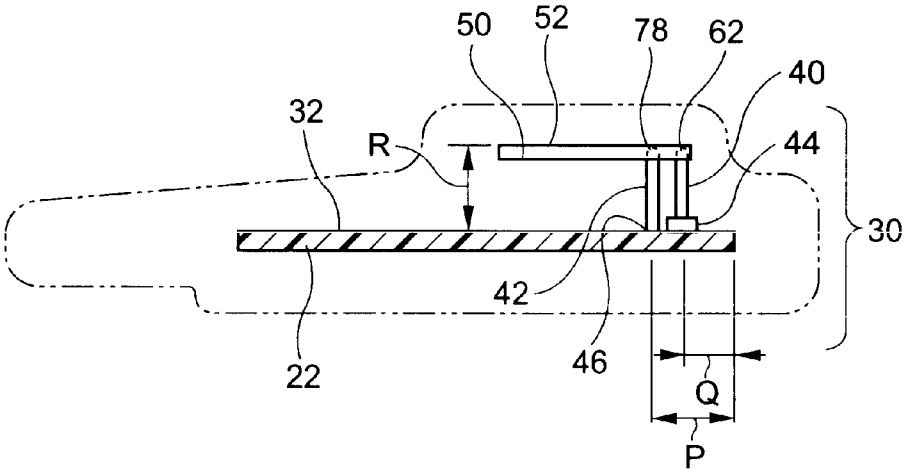
FIG. 3B is a edge elevational view of the first embodiment of the antenna assembly of FIG. 2 taken from a side of a wireless communication device, the wireless communication device depicted in phantom.
Figure 3A:
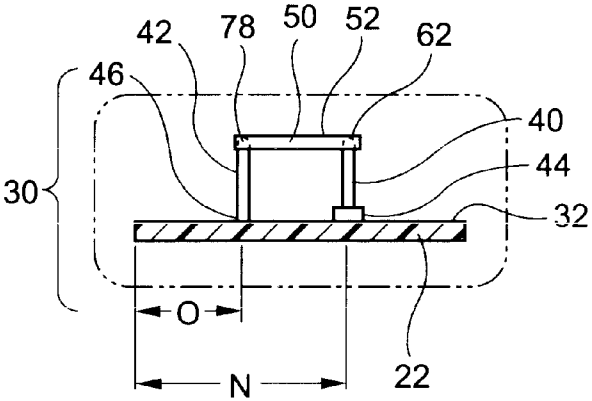
FIG. 3A is an end elevational view of the first embodiment of the antenna assembly of FIG. 2 taken from the top of a wireless communication device, the wireless communication device depicted in phantom.
Figures 4A, 4B:
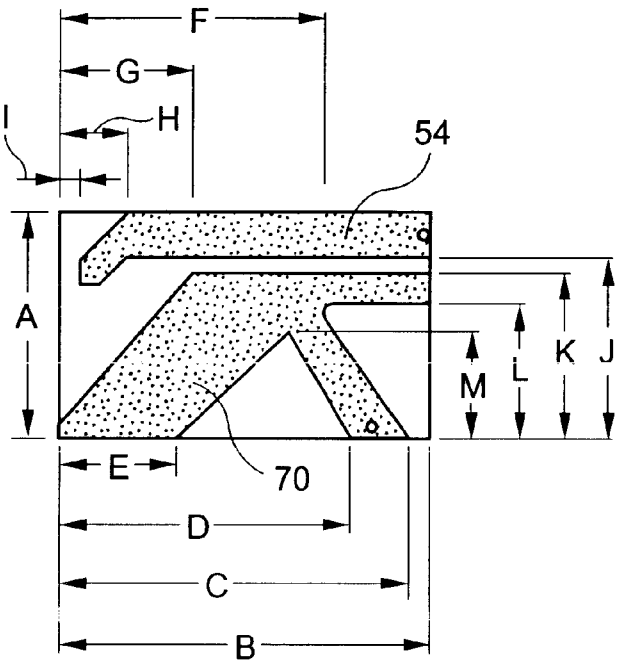
FIG. 4A is a partial plan view of the driven and parasitic elements and attendant dielectric element of the first embodiment of the antenna assembly.
FIG. 4B is a table showing preferred dimensions of the antenna assembly of FIG. 4A, according to the present invention.
Figure 5:
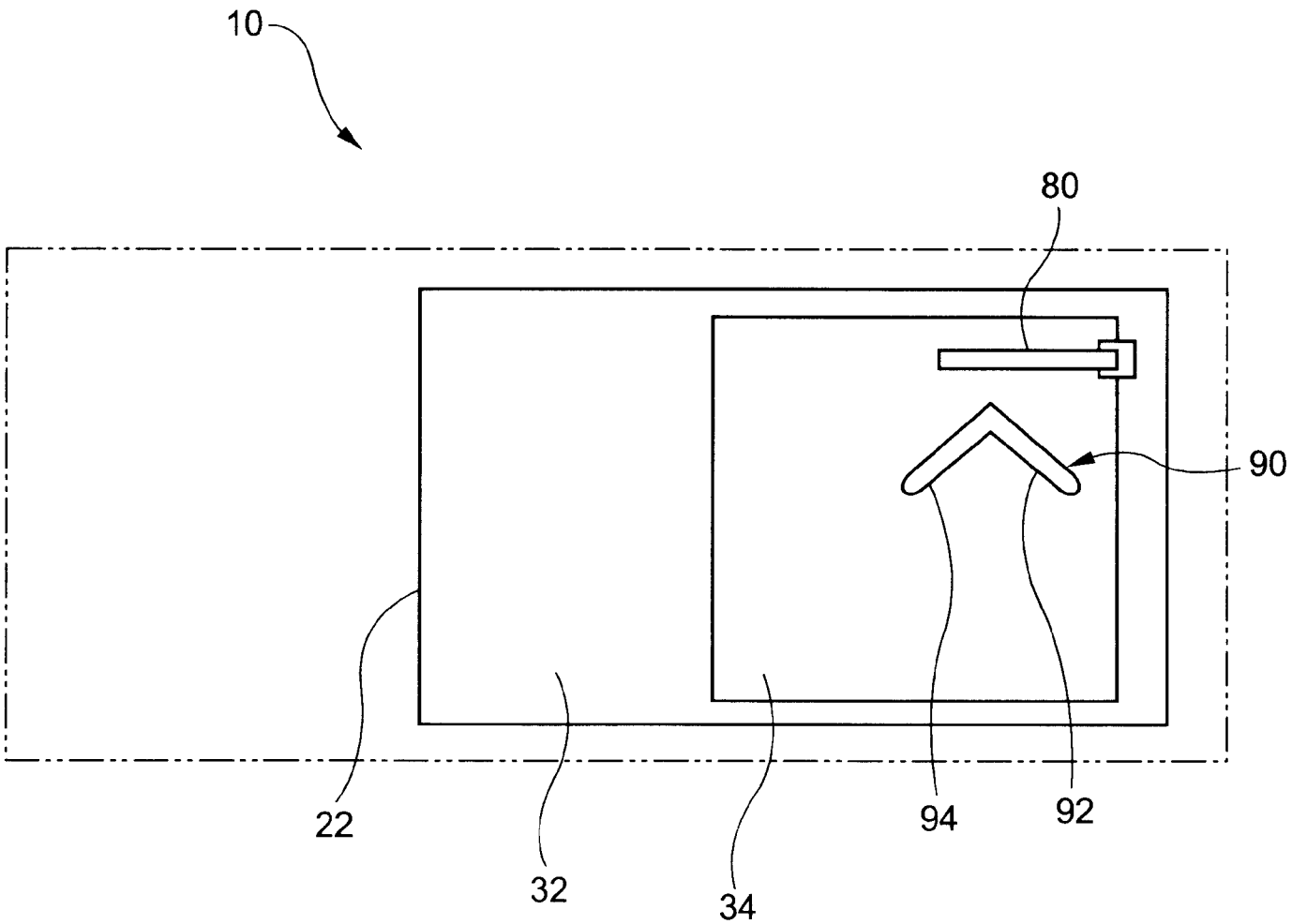
FIG. 5 is a plan view of a second embodiment of the antenna assembly according to the present invention taken from the back of a wireless communication device, the wireless communication device depicted in phantom.

As depicted in FIGS. 3A and 3B, the first connector member 40 operatively connects the feed point 62 of the first trace 54 to an input/output port 44. As mentioned previously, the input/output port 44 is adjacent to and in a fixed position relative to the ground plane 32. Note, however, that although the input/output port 44 is depicted as being adjacent the ground plane 32 of the printed wiring board 22, it will be appreciated that the input/output port 44 may be at other locations. For example, within the predetermined region 34 of the ground plane 32, and preferably at the coordinates defined by distances N and Q (See FIGS. 3A, 3B). The second connector member 42 operatively connects the ground connection point 78 to the ground point 46 on the ground plane 32. Note that the ground point 46 is located within the predetermined region 34 of the ground plane 32 and preferably at the coordinates defined by distances O and P (See also, FIGS. 3A, 3B).

The traces themselves 54, 70 may be manufactured using existing circuit board fabrication technologies, such as metallic deposition or etching, or may even take the form of foil which is secured to a suitable substrate. Preferably, the first trace 54 is generally linear and includes ends 56, 58 one of which includes a tip 60, the other of which includes a feed point 62. The second trace 70 includes first, second, and third segments 72, 74 and 76 with the second segment 74 including a ground connection point 78. While the preferred embodiment may be constructed according to the dimensions listed in Table 1 depicted in FIG. 4B, it will be appreciated that variations are possible. The distance between the confronting edges of the first and second traces 54, 70 is dependent upon the frequency of operation.

Turning to FIGS. 5–7B, a second preferred embodiment of the present invention the antenna assembly 30 comprises a plurality of body members 80, 90 which are operatively connected to an input/output port 44 and a ground point 46 on the ground plane 32 by first and second connector members 40, 42, respectively. Unlike the traces of the first embodiment, it will be appreciated that the body members 80, 90 do not require a substrate in supporting relation thereto. Rather, the first and second body members 80, 90 are supported by connector members 40, 42. The first connector member 40 operatively connects the first body member 80 to an input/output port 44 which, as explained previously, is in a fixed position relative to the ground plane 32. As with the aforementioned first embodiment, it will be appreciated that the input/output port 44 may be at other locations.

Figure 6B:
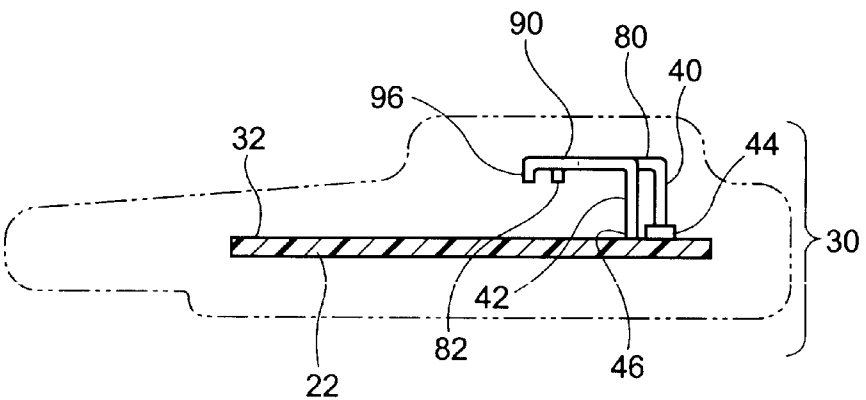
FIG. 6B is a edge elevational view of the second embodiment of the antenna assembly of FIG. 5 taken from a side of a wireless communication device, the wireless communication device depicted in phantom.
Figure 6A:
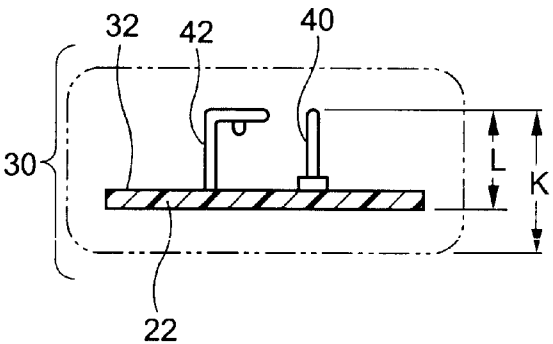
FIG. 6A is an end elevational view of the second embodiment of the antenna assembly of FIG. 5 taken from the top of a wireless communication device, the wireless communication device depicted in phantom.

In a departure from the trace of the first embodiment, the body member 80 includes an arm member 82 which extends toward the ground plane 32 rather that extending from the first body member 80 in a co-planar direction (See FIGS. 6A and 6B). The resultant structure of the first body member 80, the connector member 40 and the arm member 82 is in the general shape of an inverted u-shaped hook. The second connector member 42 operatively connects the second body member 90 to a ground point 46 on the ground plane 32 as in the aforementioned first embodiment. Also in a departure from the trace of the first embodiment, the second body member 90 includes a first body segment 92 and a second body segment 94 which are co-planar and arranged to form an angle with an apex. Similar to the first body member 80, the second body member 90 includes an arm member 96 which extends from the end of body segment 94 towards the ground plane 32 (See also FIGS. 6A and 6B). The resultant structure of the second body member 90, the arm member 96 and the connector member 42 is also in the general shape of an inverted u-shaped hook. As with the aforementioned first embodiment, the driven element 80 and parasitic element 90 are superposed over a predetermined region 34 of the ground plane 32.

Figure 7A:
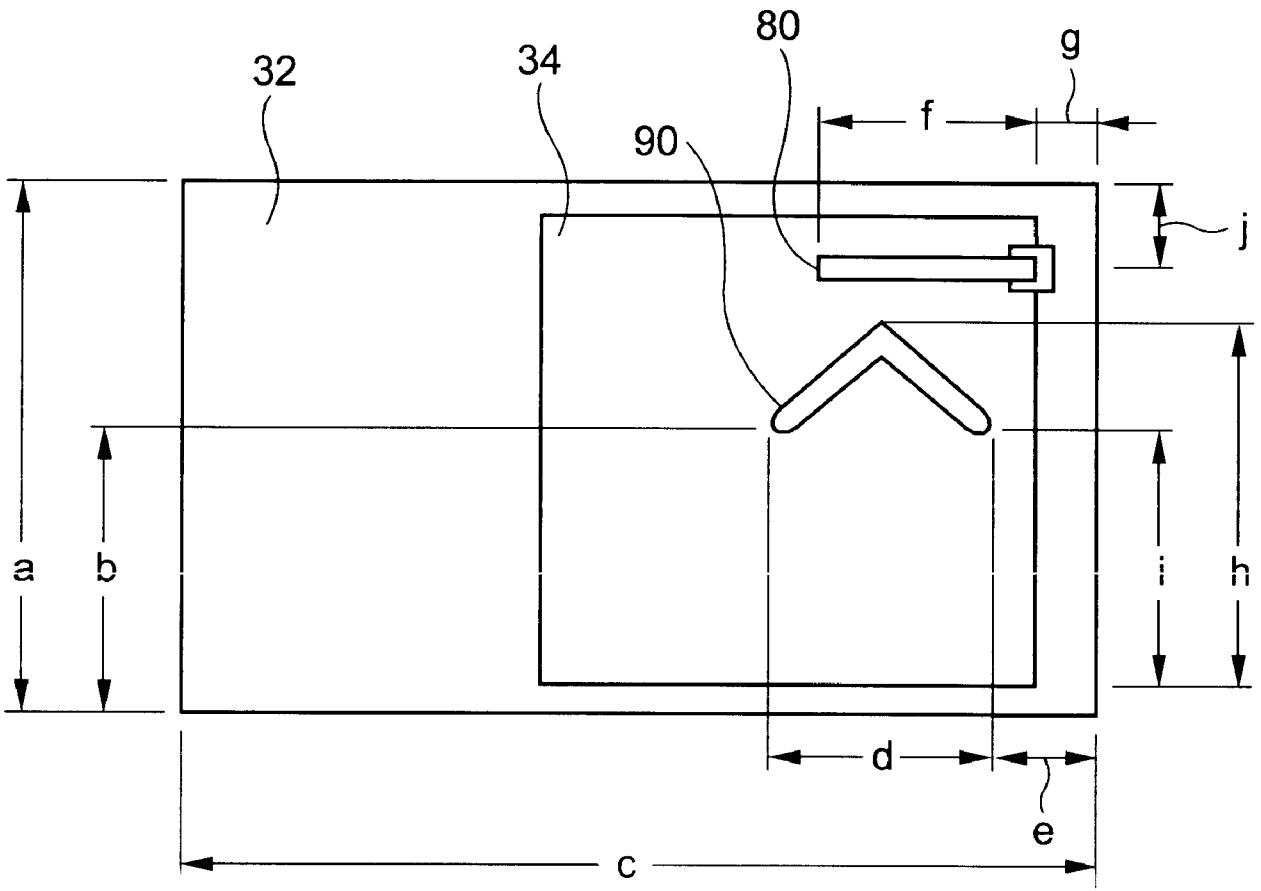
FIG. 7A is an enlarged plan view of the driven and parastic elements and associated ground plane of the second embodiment of the antenna assembly of FIG. 5.
Figure 8:
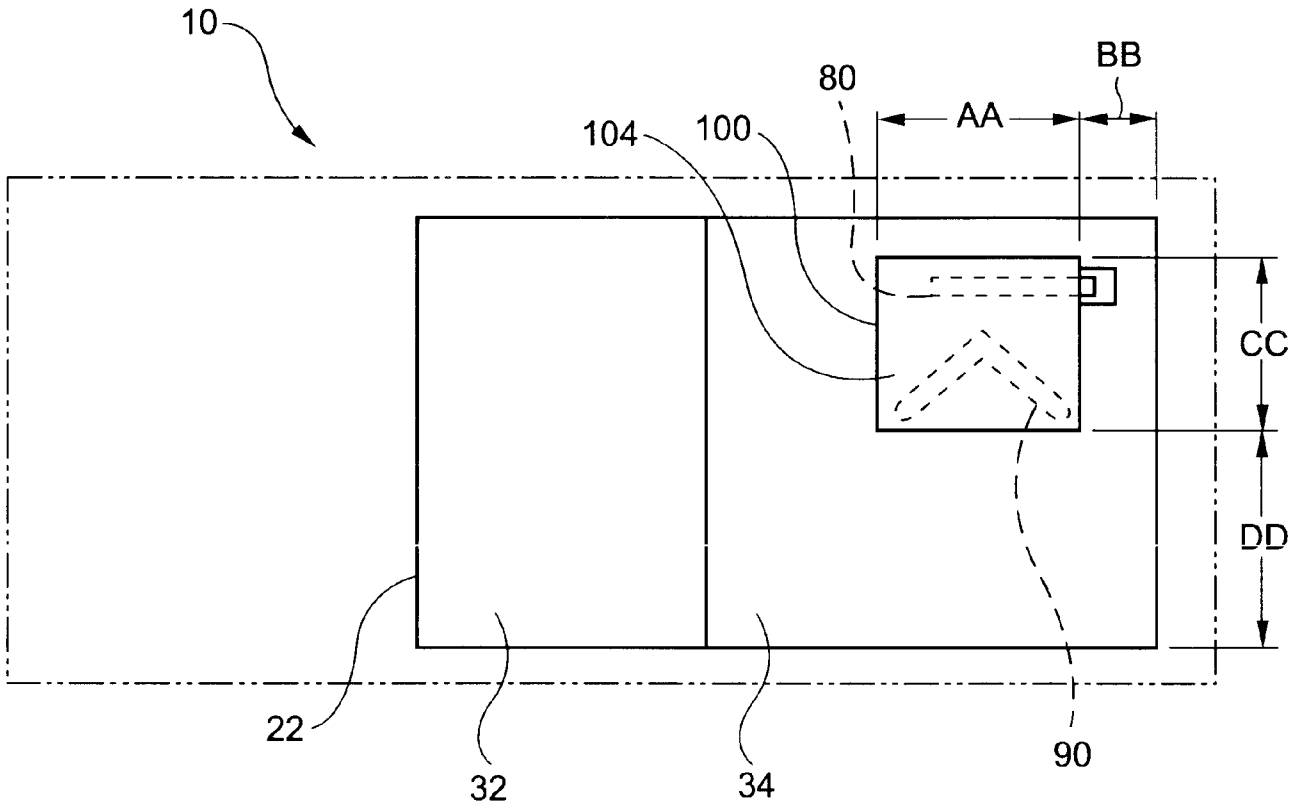
FIG. 8 is a plan view of a third embodiment of the antenna assembly according to the present invention taken from the back of a wireless communication device, the wireless communication device depicted in phantom.
Figure 9B:
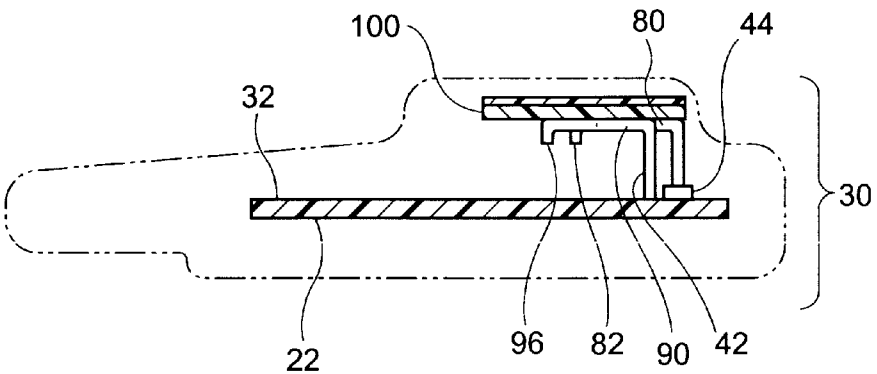
FIG. 9B is a edge elevational view of the third embodiment of the antenna assembly of FIG. 2 taken from a side of a wireless communication device, the wireless communication device depicted in phantom.
Figure 9A:
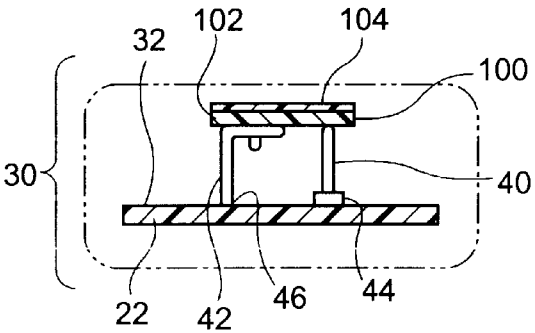
FIG. 9A is an end elevational view of the third embodiment of the antenna assembly of FIG. 8 taken from the top of a wireless communication device, the wireless communication device depicted in phantom.

While the preferred embodiment may be constructed according to the dimensions listed in Table 2 depicted in FIG. 7B, it will be appreciated that variations are possible. In this embodiment, the antenna was specified for operation across the UMTS band In a third preferred embodiment, the aforementioned body members of the second embodiment of the antenna assembly 30 are used as a feed structure with an auxiliary antenna element 100. More specifically, as depicted in FIGS. 8–9B, the first and second body members 80, 90 are in supporting relation to the auxiliary antenna element 100 which includes a dielectric member 102 and a conductor element 104. In use, the first and second body members 80, 90 serve as a feed system for the auxiliary antenna element 100 resulting in an ultra-wide operational bandwidth auxiliary antenna. Preferably, the auxiliary antenna element 100 has dimensions of approximately 0.1λ×0.1λ, where λ is the wavelength of the lowest frequency. As an example, an antenna is disclosed for operation across a bandwidth of 1710–2500 MHz. Correspondingly, the ground plane 32 has dimensions of approximately 0.45λ×0.25λ, also where λ is the wavelength of the lowest frequency (1710 MHz) in the bandwidth of 1710–2500 MHz. Preferably, as with the other aforementioned embodiments, the auxiliary antenna element 100 is superposed over a predetermined region 34 of the ground plane 32. While the preferred embodiment may be constructed according to the dimensions listed in Table 2 depicted in FIG. 7B, it will be appreciated that variations are possible. This particular preferred embodiment operates over a frequency of 1710–2500 MHz with a voltage standing wave ratio (VSWR)<3:1. Additional embodiments may include a dielectric substrate having patterned conductive layers or foils disposed upon its surfaces. In yet other embodiments, the antenna may be manufactured as printed circuit board elements, bent metal structures, conductive coatings or foils disposed upon a dielectric, etc. as obvious to one skilled in the art. Additionally, other frequency bands of operation may be practicable by scaling the dimensions of the elements as presented herein.

Figure 10:
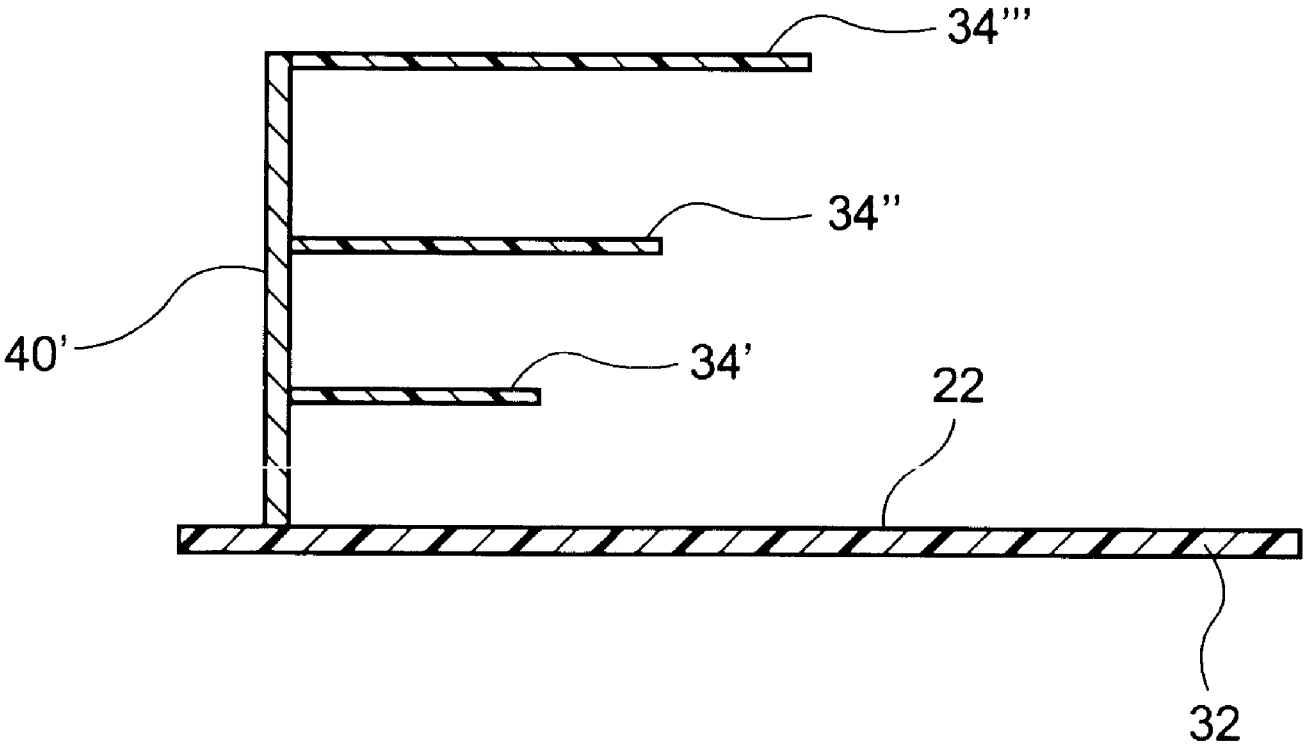
FIG. 10 is a side elevational view of another embodiment of the antenna assembly according to the present invention, incorporating a plurality of antenna structures for multiple band operation.
Figure 11:
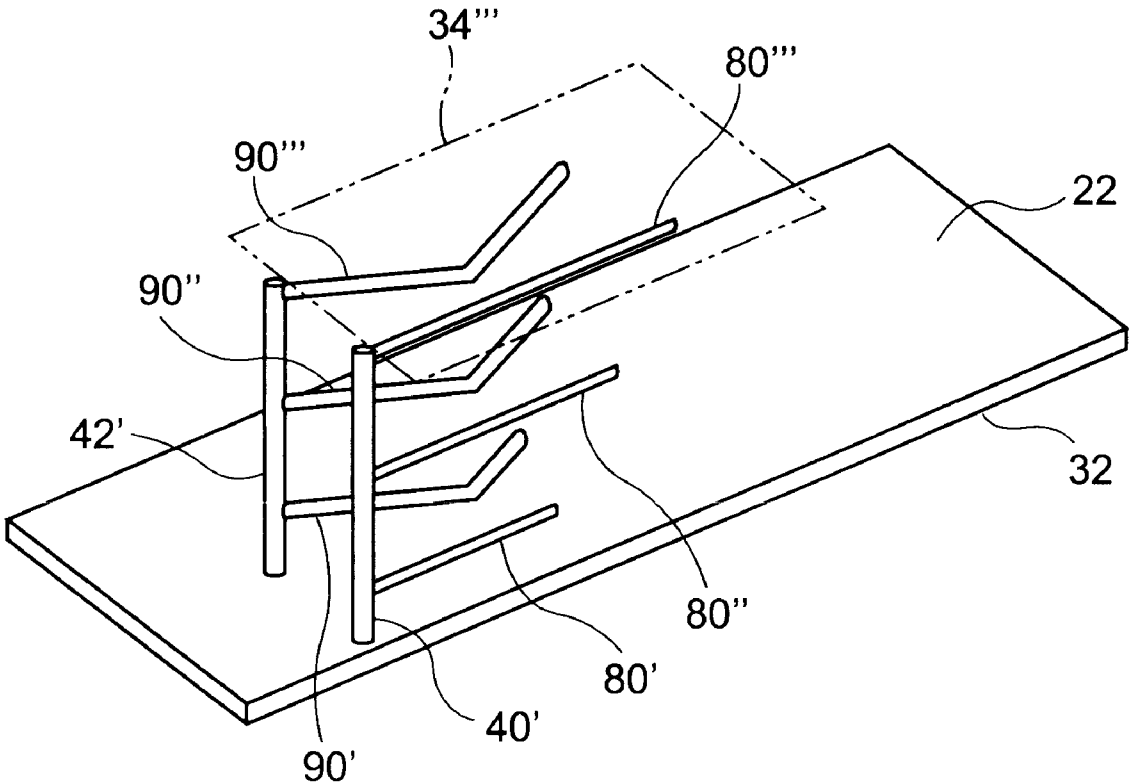
FIG. 11 is a perspective view of the multiple band antenna assembly of FIG. 10.

In a fourth embodiment as illustrated in FIGS. 10 and 11, an antenna assembly for multiple band operation can be achieved with a plurality of antenna components, 34', 34", 34'". The antenna can be configured to provide multi-band operation using a single RF Feed line 40', by stacking antenna assemblies in substantially co-parallel configuration. Each stacked assembly 34 is composed of driven and parasitic conductive elements 80, 90 disposed upon a dielectric substrate, with feed and ground point connections 40', 42 for each stacked assembly. A single feed line 40' and single ground connector 42' may be used to access each of the stacked layers sequentially. The size of each layer is scaled for the appropriate frequency and stacked at a height determined by the desired frequency band of operation. The stacked driven and parasitic elements may share common vertical elements for physical support, for feed line and grounding line. The spacings between stacked assemblies and the ground plane are determined by the frequency desired, as could be determined by one skilled in the art. The smallest of the stacked assemblies having the corresponding smallest sized driven and parasitic elements, would provide the highest frequency band, and is placed closest to the ground plane. Larger scaled stacked assemblies, with corresponding lower frequency bands, would need to be arranged farther from the ground plane for proper performance. As an example, such an antenna could be configured to cover the U.S. cell band (824–894) MHz, PCS/DCS bands (1710–1990) MHz and Bluetooth frequency band (2.4–2.5) GHz.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed:

1. An antenna assembly for use in a wireless communication device having a ground plane and an input/output RF connector, said antenna assembly for transmitting and receiving about a predetermined wavelength, said antenna assembly comprising:

a driven element having a predetermined configuration, said driven element being disposed away from the ground plane and having a length of substantially less than one-quarter of the predetermined wavelength, said driven element coupled to the RF connector proximate to a first end; and a parasitic element having a predetermined configuration, said parasitic element being disposed away from the ground plane and having a length of substantially less than one-quarter of the predetermined wavelength, with the parasitic element being spaced from the driven element a predetermined distance, said parasitic element being coupled to the ground plane of the wireless communication device, wherein the driven element and the parasitic element are substantially co-planar, and wherein the driven element has a generally linear configuration and the parasitic element has a generally nonlinear configuration, said parasitic element having a plurality of disjointed nonparallel sections.

2. The antenna assembly of claim 1, wherein the driven element and parasitic element are spaced a predetermined distance away from the ground plane.

3. The antenna assembly of claim 2, wherein the driven element and parasitic element are substantially collateral with the ground plane.

4. The antenna assembly of claim 3, wherein the driven element and parasitic element are superposed over a predetermined region of the ground plane.

5. The antenna assembly of claim 1, further including a generally planar dielectric element in supporting relation to the driven element.

6. The antenna assembly of claim 1, further including a dielectric element in supporting relation to the parasitic element.

7. The antenna assembly of claim 1, further including a dielectric element in supporting relation to the driven element and parasitic element.

8. The antenna assembly of claim 7, wherein the dielectric element is spaced a predetermined distance away from the ground plane.

9. The antenna assembly of claim 1, wherein the driven element and parasitic element are selected from among the group including: solid wire elements, plated metal elements, metal foil elements, and sheet metal elements.

10. An antenna assembly for use in a wireless communication device having a ground plane and an input/output RF connector, said antenna assembly for transmitting and receiving about a predetermined wavelength, said antenna assembly comprising:

a driven element having a predetermined configuration, said driven element being disposed away from the ground plane and having a length of substantially less than one-quarter of the predetermined wavelength, said driven element coupled to the RF connector proximate to a first end; and a parasitic element having a predetermined configuration, said parasitic element being disposed away from the ground plane and having a length of substantially less than one-quarter of the predetermined wavelength, with the parasitic element being spaced from the driven element a predetermined distance, said parasitic element being coupled to the ground plane of the wireless communication device, wherein the driven element and the parasitic element are first and second generally planar conductive traces disposed upon a generally planar dielectric substrate element.

11. The antenna assembly of claim 10, wherein the first conductive trace includes a substantially linear conductor portion and wherein the second conductive trace includes at least two nonparallel substantially linear conductor portions.

12. The antenna assembly of claim 11, wherein the first conductive trace and the second conductive trace are superposed over a predetermined region of the ground plane.

13. The antenna assembly of claim 10, wherein the first conductive trace has a predetermined surface area and wherein the second conductive trace has a predetermined surface area which is substantially larger than the surface area of the first conductive trace.

14. An antenna assembly for use in a wireless communication device having a ground plane and an input/output RF connector, said antenna assembly for transmitting and receiving about a predetermined wavelength, said antenna assembly comprising:

a driven element having a predetermined configuration, said driven element being disposed away from the ground plane and having a length of substantially less than one-quarter of the predetermined wavelength, said driven element coupled to the RF connector proximate to a first end; and a parasitic element having a predetermined configuration, said parasitic element being disposed away from the ground plane and having a length of substantially less than one-quarter of the predetermined wavelength, with the parasitic element being spaced from the driven element a predetermined distance, said parasitic element being coupled to the ground plane of the wireless communication device, wherein the driven element includes a body member and an arm member downwardly extending toward the ground plane at an end opposite the first end.

15. The antenna assembly of claim 14, wherein the parasitic element includes a first body member, a second body member and an arm member downwardly extending toward the ground plane at an end opposite the first end.

16. The antenna assembly of claim 15, wherein a portion of the body member of the driven element and the first and second body members of the parasitic element are co-planar.

17. The antenna assembly of claim 16, further comprising a dielectric member having a conductor element.

18. The antenna assembly of claim 17, wherein the dielectric member is adjacent the driven element and the parasitic element.

19. The antenna assembly of claim 17, wherein the dielectric member is in contacting relation to the body member of the driven element and the first and second body members of the parasitic element.

20. The antenna assembly of claim 15, wherein the body member of the driven element and the first body member of the parasitic element are superposed over a predetermined region of the ground plane.

21. A bandwidth enhanced antenna assembly for use in a wireless communication device having a ground plane and an input/output RF connector, said antenna assembly for transmitting and receiving about a predetermined wavelength, said antenna assembly comprising:

a driven element being disposed away from the ground plane and having a length of substantially less than one-quarter of the predetermined wavelength, said driven element coupled to the RF connector proximate to a first end; and a parasitic element, said parasitic element being disposed away from the ground plane and having a length of substantially less than one-quarter of the predetermined wavelength, with the parasitic element spaced from the driven element a predetermined distance, said parasitic element being coupled to the ground plane of the wireless communication device, wherein said driven element in combination with the parasitic element provide an enhanced operational bandwidth, wherein the driven element and the parasitic element are substantially co-planar, and wherein the driven element has a generally linear configuration and the parasitic element has a generally nonlinear configuration, said parasitic element having a plurality of disjointed nonparallel sections.

22. The antenna assembly of claim 21, wherein the driven element and parasitic element are spaced a predetermined distance away from the ground plane.

23. The antenna assembly of claim 22, wherein the driven element and parasitic element are substantially collateral with the ground plane.

24. The antenna assembly of claim 23, wherein the driven element and parasitic element are superposed over a predetermined region of the ground plane.

25. The antenna assembly of claim 21, further including a dielectric element in supporting relation to the driven element and parasitic element.

26. The antenna assembly of claim 21, wherein the driven element and parasitic element are selected from among the group including: solid wire elements, plated metal elements, metal foil elements, and sheet metal elements.

27. A bandwidth enhanced antenna assembly for use in a wireless communication device having a ground plane and an input/output RF connector, said antenna assembly for transmitting and receiving about a predetermined wavelength, said antenna assembly comprising:

a driven element being disposed away from the ground plane and having a length of substantially less than one-quarter of the predetermined wavelength, said driven element coupled to the RF connector proximate to a first end; and a parasitic element, said parasitic element being disposed away from the ground plane and having a length of substantially less than one-quarter of the predetermined wavelength, with the parasitic element spaced from the driven element a predetermined distance, said parasitic element being coupled to the ground plane of the wireless communication device, wherein said driven element in combination with the parasitic element provide an enhanced operational bandwidth, and wherein the driven element and the parasitic element are first and second generally planar conductive traces disposed upon a generally planar dielectric substrate element.

28. The antenna assembly of claim 27, wherein the first conductive trace includes a substantially linear conductor portion and wherein the second conductive trace includes at least two nonparallel substantially linear conductor portions.

29. A bandwidth enhanced antenna assembly for use in a wireless communication device having a ground plane and an input/output RF connector, said antenna assembly for transmitting and receiving about a predetermined wavelength, said antenna assembly comprising:

a driven element being disposed away from the ground plane and having a length of substantially less than one-quarter of the predetermined wavelength, said driven element coupled to the RF connector proximate to a first end; and a parasitic element, said parasitic element being disposed away from the ground plane and having a length of substantially less than one-quarter of the predetermined wavelength, with the parasitic element spaced from the driven element a predetermined distance, said parasitic element being coupled to the ground plane of the wireless communication device, wherein said driven element in combination with the parasitic element provide an enhanced operational bandwidth, and wherein the driven element includes a body member and an arm member downwardly extending toward the ground plane at an end opposite the first end.

30. The antenna assembly of claim 29, wherein the parasitic element includes a first body member, a second body member and an arm member downwardly extending toward the ground plane at an end opposite the first end.

31. The antenna assembly of claim 30, wherein a portion of the body member of the driven element and the first and second body members of the parasitic element are co-planar.

32. The antenna assembly of claim 30, wherein the body member of the driven element and the first body member of the parasitic element are superposed over a predetermined region of the ground plane.

33. An aperture-coupled bandwidth enhanced antenna assembly for use in a wireless communication device having a ground plane and an input/output RF connector, said antenna assembly for transmitting and receiving about a predetermined wavelength, said antenna assembly comprising:

a driven element being disposed away from the ground plane and having a length of substantially less than one-quarter of the predetermined wavelength, said driven element coupled to the RF connector;

a parasitic element, said parasitic element being disposed away from the ground plane and having a length of substantially less than one-quarter of the predetermined wavelength, with the parasitic element spaced from the driven element a predetermined distance, said parasitic element being coupled to the ground plane of the wireless communication device; and an auxiliary antenna element including a dielectric substrate element disposed relative a portion of both the driven element and the parasitic element and a conductive element disposed upon the dielectric substrate at an upper surface, wherein said driven element in combination with the auxiliary antenna element provide an enhanced operational bandwidth.

34. The antenna assembly of claim 33, wherein the driven element and parasitic element are substantially co-planar.

35. The antenna assembly of claim 34, wherein the dielectric substrate element is substantially planar.

36. The antenna assembly of claim 34, wherein the driven element and the parasitic element are each in contacting relationship with the dielectric substrate element.

37. The antenna assembly of claim 33, wherein the driven element and parasitic element are spaced a predetermined distance away from the ground plane.

38. The antenna assembly of claim 37, wherein the driven element and parasitic element are substantially collateral with the ground plane.

39. The antenna assembly of claim 38, wherein the driven element and parasitic element are superposed over a predetermined region of the ground plane.

40. The antenna assembly of claim 33, further including a dielectric element in supporting relation to the driven element and parasitic element.

41. The antenna assembly of claim 33 wherein the driven element and parasitic element are first and second conductive traces, respectively.

42. The antenna assembly of claim 41, wherein the first trace includes a substantially linear conductor portion and wherein the second trace includes at least two substantially linear conductor portions.

43. The antenna assembly of claim 33, wherein the driven element includes a body member and an arm member.

44. The antenna assembly of claim 43, wherein the parasitic element includes a first body member, a second body member and an arm member.

45. The antenna assembly of claim 44, wherein the arm members of the driven element and parasitic element extend towards the ground plane.

46. The antenna assembly of claim 44, wherein the driven element and parasitic element are selected from among the group including: solid wire elements, plated metal elements, metal foil elements, and sheet metal elements.

47. The antenna assembly of claim 44, wherein a portion of the body member of the driven element and the first and second body members of the parasitic element are co-planar.

48. The antenna assembly of claim 44, wherein the body member of the driven element and the first body member of the parasitic element are superposed over a predetermined region of the ground plane.

49. A multiple bandwidth antenna assembly for use in a wireless communication device having a ground plane and an input/output RF connector, said antenna assembly for transmitting and receiving about a plurality of predetermined wavelengths, said antenna assembly comprising:

a plurality of driven elements each being disposed away from the ground plane by a predetermined different distance and each having a length of substantially less than one-quarter of one of the plurality of predetermined wavelengths, each of said plurality of driven elements coupled to the RF connector; and a plurality of parasitic elements each being disposed away from the ground plane by a predetermined different distance and each having a length of substantially less than one-quarter of one of the plurality of predetermined wavelengths, each of said plurality of parasitic elements spaced from an associated one of the plurality of driven elements, each of said plurality of parasitic elements being coupled to the ground plane of the wireless communication device wherein associated pairs of driven elements and parasitic elements are substantially co-planar.

50. The antenna assembly of claim 49, further including a plurality of dielectric elements in supporting relation to associated pairs of driven elements and parasitic elements.

51. The antenna assembly of claim 49 wherein the plurality of driven elements and parasitic elements are selected from among the group including conductive traces, conductive wires, plated metal elements, foil metal elements, and sheet metal elements.

52. A multiple bandwidth antenna assembly for use in a wireless communication device having a ground plane and an input/output RF connector, said antenna assembly for transmitting and receiving about a plurality of predetermined wavelengths, said antenna assembly comprising:

a plurality of driven elements each being disposed away from the ground plane by a predetermined different distance and each having a length of substantially less than one-quarter of one of the plurality of predetermined wavelengths, each of said plurality of driven elements coupled to the RF connector through a first common vertical conductor element; and a plurality of parasitic elements each being disposed away from the ground plane by a predetermined different distance and each having a length of substantially less than one-quarter of one of the plurality of predetermined wavelengths, each of said plurality of parasitic elements spaced from an associated one of the plurality of driven elements, each of said plurality of parasitic elements being coupled to the ground plane of the wireless communication device through a second common vertical conductor element.

53. A multiple bandwidth antenna assembly of claim 52 wherein associated pairs of driven elements and parasitic elements are substantially co-planar.

* * * * *